US006703535B2

(12) United States Patent
Johnson et al.

(10) Patent No.: US 6,703,535 B2
(45) Date of Patent: Mar. 9, 2004

(54) PROCESS FOR UPGRADING FISCHER-TROPSCH SYNCRUDE USING THERMAL CRACKING AND OLIGOMERIZATION

(75) Inventors: David R. Johnson, Petaluma, CA (US); Christopher A. Simmons, El Cerrito, CA (US); Donald H. Mohr, Orinda, CA (US); Stephen J. Miller, San Francisco, CA (US); Stephen K. Lee, Oakland, CA (US); William L. Schinski, San Rafael, CA (US); Michael S. Driver, San Francisco, CA (US); William J. Cannella, Hercules, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/125,879

(22) Filed: Apr. 18, 2002

(65) Prior Publication Data

US 2003/0199719 A1 Oct. 23, 2003

(51) Int. Cl.[7] ..... C07C 2/04; C10G 57/02

(52) U.S. Cl. ..... 585/303; 585/302; 585/304; 585/329; 585/330; 208/950

(58) Field of Search ..... 208/950; 585/302, 585/303, 304, 329, 330

(56) References Cited

U.S. PATENT DOCUMENTS

| | | | | |
|---|---|---|---|---|
| 2,452,121 A | * | 10/1948 | Grahame | 518/719 |
| 3,845,157 A | | 10/1974 | Woo | |
| 4,042,488 A | | 8/1977 | Perciful | |
| 4,125,566 A | * | 11/1978 | Trin Dinh et al. | 208/65 |
| 4,417,088 A | | 11/1983 | Miller | |
| 4,579,986 A | | 4/1986 | Sie | |
| 4,642,401 A | | 2/1987 | Coenen et al. | |
| 5,371,308 A | * | 12/1994 | Gosselink et al. | 585/251 |
| 5,413,695 A | | 5/1995 | Miller | |
| 5,453,556 A | * | 9/1995 | Chang et al. | 585/524 |
| 5,514,362 A | | 5/1996 | Miller | |
| 5,849,964 A | | 12/1998 | Holighaus et al. | |
| 6,143,940 A | | 11/2000 | Miller et al. | |
| 6,150,577 A | | 11/2000 | Miller et al. | |
| 6,288,296 B1 | | 9/2001 | Miller et al. | |

FOREIGN PATENT DOCUMENTS

| | | |
|---|---|---|
| EP | 0 584 879 A1 | 3/1994 |
| EP | 0 620 264 A2 | 10/1994 |
| GB | 495477 | 11/1938 |

* cited by examiner

*Primary Examiner*—Walter D. Griffin
(74) *Attorney, Agent, or Firm*—James W. Ambrosius

(57) ABSTRACT

A process for upgrading a Fischer-Tropsch feedstock which comprises (a) recovering from a Fischer-Tropsch reactor a Fischer-Tropsch wax fraction and a Fischer-Tropsch condensate fraction, wherein the Fischer-Tropsch condensate fraction contains alcohols boiling below about 370° C.; (b) contacting the Fischer-Tropsch condensate fraction with a dehydration catalyst in a dehydration zone under dehydration conditions pre-selected to convert at least some of the alcohols present in said fraction into olefins and recovering a first intermediate effluent from said dehydration zone; (c) pyrolyzing the paraffins in the Fischer-Tropsch wax fraction in a thermal cracking zone under thermal cracking conditions pre-selected to crack the Fischer-Tropsch wax molecules to form olefins and collecting a second intermediate effluent from the thermal cracking zone; (d) passing the first and second intermediate effluents recovered from steps (b) and (c) to an oligomerization zone containing an oligomerization catalyst under oligomerization conditions to form an oligomerization mixture having a higher molecular weight than either of said first and second intermediate effluent; (e) hydrofinishing the oligomerization mixture in a hydrofinishing zone; and (f) recovering from the hydrofinishing zone a $C_{10}$ plus hydrocarbon product, most preferably a lubricating base oil.

40 Claims, 2 Drawing Sheets

PROCESS FOR UPGRADING FISCHER-TROPSCH SYNCRUDE USING THERMAL CRACKING AND OLIGOMERIZATION

FIELD OF THE INVENTION

The invention relates to a process for upgrading Fischer-Tropsch products by increasing the yield of lubricating base oil and diesel.

BACKGROUND OF THE INVENTION

The market for lubricating base oils of high paraffinicity is continuing to grow due to the high viscosity index, oxidation stability, and low volatility relative to viscosity of these molecules. The products produced from the Fischer-Tropsch process contain a high proportion of wax which make them ideal candidates for processing into lubricating base oil stocks. Accordingly, the hydrocarbon products recovered from the Fischer-Tropsch process have been proposed as feedstocks for preparing high quality lubricating base oils. See, for example, U.S. Pat. No. 6,080,301 which describes a premium lubricating base oil having a high non-cyclic isoparaffin content prepared from Fischer-Tropsch waxes by hydroisomerization dewaxing and solvent dewaxing.

The economics of a Fischer-Tropsch complex has in the past only been desirable in isolated areas, however, such a Fischer-Tropsch complex can benefit if the production of high-value products in the product slate, such as lubricating base oil and high quality diesel, can be increased. Lubricating base oils typically will have an initial boiling point above about 315° C. (600° F.). Using the process described herein the amount of lubricating base oils derived from the Fischer-Tropsch synthesis may be significantly increased. If desired, high quality diesel products also may be prepared from the syncrude recovered from the Fischer-Tropsch process. Fischer-Tropsch derived diesel typically has a very low sulfur and aromatics content and an excellent cetane number. In addition, the process of the present invention makes it possible to produce diesel having low pour and cloud points, which enhance the quality of the product. These qualities make Fischer-Tropsch derived diesel an excellent blending stock for upgrading lower quality petroleum-derived diesel. Accordingly, it is desirable to be able to maximize the yields of such higher value hydrocarbon products which boil within the range of lubricating base oils and diesel. At the same time, it is desirable to minimize the yields of lower value products such as naphtha and $C_4$ minus products. The present invention makes these goals possible.

Fischer-Tropsch wax refers to a high boiling fraction from the Fischer-Tropsch derived syncrude and is most often a solid at room temperature. For the purpose of this disclosure "Fischer-Tropsch wax" will be contained in the higher boiling portion of the Fischer-Tropsch syncrude. Fischer-Tropsch wax contains at least 10% by weight of $C_{20}$ and higher hydrocarbonaceous compounds, preferably at least 40% by weight of $C_{20}$ and higher hydrocarbonaceous compounds, and most preferably at least 70% by weight of $C_{20}$ and higher hydrocarbonaceous compounds.

All syncrude Fischer-Tropsch products as they are initially recovered from the Fischer-Tropsch reactor contain varying amounts of olefins depending upon the type of Fischer-Tropsch operation employed. In addition, the crude Fischer-Tropsch product also contains a certain amount of oxygenated hydrocarbons, especially alcohols, which may be readily converted to olefins by a dehydration step. These olefins may be oligomerized to yield hydrocarbons having a higher molecular weight than the original feed. Oligomerization also introduces desirable branching into the hydrocarbon molecule which lowers the pour point of the diesel and lubricating base oil products thereby improving the cold flow properties of the product. See for example U.S. Pat. No. 4,417,088. In the present invention most of the alcohols will be included in the condensate fraction recovered from the Fischer-Tropsch unit. As used in this disclosure, the term "Fischer-Tropsch condensate" refers generally to the $C_5$ plus fraction which has a lower boiling point than the Fischer-Tropsch wax fraction. That is to say, that fraction which is normally liquid at ambient temperature.

As used in this disclosure, the term "$C_{19}$ minus Fischer-Tropsch product" refers to a product recovered from a Fischer-Tropsch reaction zone which is predominantly comprised of hydrocarbons having 19 carbon atoms or less in the molecular backbone. One skilled in the art will recognize that such products may actually contain a significant amount of hydrocarbons containing greater than 19 carbon atoms. In general, what is referred to are those hydrocarbons having a boiling range of diesel and below. In general, for the purposes of this disclosure, diesel is considered as having a upper boiling point of about 700° F. (370° C.) and an initial boiling point of about 300° F. (about 150° C.). Diesel may also be referred to as $C_{10}$ to $C_{19}$ hydrocarbons. Likewise, Fischer-Tropsch wax preferably is comprised predominantly of "$C_{20}$ plus product" which refers to a product comprising primarily hydrocarbons having 20 or more carbon atoms in the backbone of the molecule and having an initial boiling point at the upper end of the boiling range for diesel, i.e., above about 600° F. (315° C.). It should be noted that the upper end of the boiling range for diesel and the lower end of the boiling range for Fischer-Tropsch wax have considerable overlap. The term "naphtha" when used in this disclosure refers to a liquid product having between about $C_5$ to about $C_9$ carbon atoms in the backbone and will have a boiling range generally below that of diesel but wherein the upper end of the boiling range will overlap that of the initial boiling point of diesel. The term $C_{10}$ plus hydrocarbons refers to those hydrocarbons generally boiling above the range of naphtha, i.e., the fractions boiling within the range of diesel and lubricating base oils or above about 150° C. Products recovered from the Fischer-Tropsch synthesis which are normally in the gaseous phase at ambient temperature are referred to as $C_4$ minus hydrocarbons in this disclosure. LPG which is primarily a mixture of propane and butane is an example of a $C_4$ minus product. The precise cut-point selected for each of the products in carrying out the distillation operation will be determined by the product specifications and yields desired.

EP patent application 0620264A2 discloses a process for making lubricating base oil from waste plastics by use of thermal cracking. U.S. Pat. No. 6,288,296 also teaches a process for converting polyethylene into high VI lubricating base oil using thermal cracking followed by dimerization and isomerization. However, neither process would be suitable for the processing of Fischer-Tropsch syncrude into lubricating base oils as contemplated herein. U.S. Pat. No. 4,579,986 describes a process in which linear paraffins are thermal cracked to yield olefins. The $C_{10}$ to $C_{19}$ olefins are treated with a peroxide to make an intermediate which may be converted into lubricating base oil. EP publication number 0584879A1 teaches the thermal cracking of a hydroprocessed Fischer-Tropsch syncrude to prepare lower olefins.

As used in this disclosure the words "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrases "consisting of" or "consists of" are intended as a transition meaning the exclusion of all but the recited elements with the exception of only minor traces of impurities.

SUMMARY OF THE INVENTION

The present invention includes a process for upgrading a Fischer-Tropsch feedstock which comprises (a) recovering from a Fischer-Tropsch reactor a Fischer-Tropsch wax fraction containing paraffins and a Fischer-Tropsch condensate fraction, wherein the Fischer-Tropsch condensate fraction contains alcohols boiling below about 370° C.; (b) contacting the Fischer-Tropsch condensate fraction with a dehydration catalyst in a dehydration zone under dehydration conditions pre-selected to convert at least some of the alcohols present in said fraction into olefins and recovering a first intermediate effluent from said dehydration zone; (c) pyrolyzing the Fischer-Tropsch wax fraction in a thermal cracking zone under thermal cracking conditions pre-selected to crack the paraffin molecules in the Fischer-Tropsch wax to form olefins and collecting a second intermediate effluent from the thermal cracking zone; (d) passing the first and second intermediate effluents recovered from steps (b) and (c) to an oligomerization zone containing an oligomerization catalyst under oligomerization conditions to form an oligomerization mixture having a higher molecular weight than either of said first and second intermediate effluent; (e) hydrofinishing the oligomerization mixture in a hydrofinishing zone; and (f) recovering from the hydrofinishing zone a $C_{10}$ plus hydrocarbon product. Preferably, the Fischer-Tropsch condensate fraction recovered in step (a) will have an olefinicity of at least 20% by weight, more preferably at least 40% by weight and most preferably at least 50% by weight. The term "paraffins" refers to saturated hydrocarbons of the methane series also called in the literature "alkanes".

In another embodiment of the invention, at least part of the second intermediate effluent is sent to an isomerization unit. The cut selected to be sent to the isomerization unit will depend upon the desired yields and properties of the final products. For example, the isomerization step may be used to improve the quality of the heavy diesel fraction, i.e., the diesel fraction boiling above about 550° F. (about 290° C.), by lowering the pour point and cloud point. The premium diesel recovered with this embodiment is a high value product which may be used as a blending stock to upgrade lower quality diesel. Alternatively, the cut may include a $C_{20}$ plus fraction which can be used to prepare a high quality lubricating base oil.

In another embodiment of the invention at least a part of the oligomerization mixture boiling below 370° C. is recycled to the thermal cracking unit. In this embodiment paraffins boiling below the upper boiling range of diesel will pass unchanged through the oligomerization unit, be recovered, generally by means of distillation, from the oligomerization mixture, and recycled to the thermal cracking zone for conversion into olefins. This embodiment is intended to maximize the yield of lubricating base oil.

The present invention is also directed to a process for increasing the yield of olefins from a Fischer-Tropsch plant which comprises (a) contacting syngas with a Fischer-Tropsch catalyst under Fischer-Tropsch reaction conditions pre-selected to yield a Fischer-Tropsch product having not less than 20% by weight olefinicity; (b) recovering from the Fischer-Tropsch product a Fischer-Tropsch wax fraction containing paraffins; (c) raising the temperature the Fischer-Tropsch wax fraction sufficiently to vaporize the fraction; (d) steam cracking the vaporized Fischer-Tropsch wax fraction in a flow through reactor under thermal cracking conditions pre-selected to achieve a cracking conversion of the paraffin molecules in the Fischer-Tropsch wax to form olefins of greater than 30% by weight; and (e) collecting an effluent having increased olefin content from the flow through reactor. In order to maximize the olefins present in the Fischer-Tropsch product, it may be advantageous to use an iron-based catalyst to carry out the Fischer-Tropsch reaction. In addition, the conditions in the flow through reactor are critical to the optimal formation of additional olefins from the paraffins present in the wax fraction. The temperature of the wax fraction must be raised to a temperature sufficient to vaporize most or all of the feed. A desirable option is to bleed any remaining nonvaporized hydrocarbons prior to entering the cracking furnace. Liquid cracking of the wax fraction will lead to the formation of undesired paraffins. However, the temperature should not be so high that the wax is over-cracked which results in the formation of excessive amounts of $C_4$ minus hydrocarbons.

DETAILED DESCRIPTION OF THE INVENTION

Figure 1:
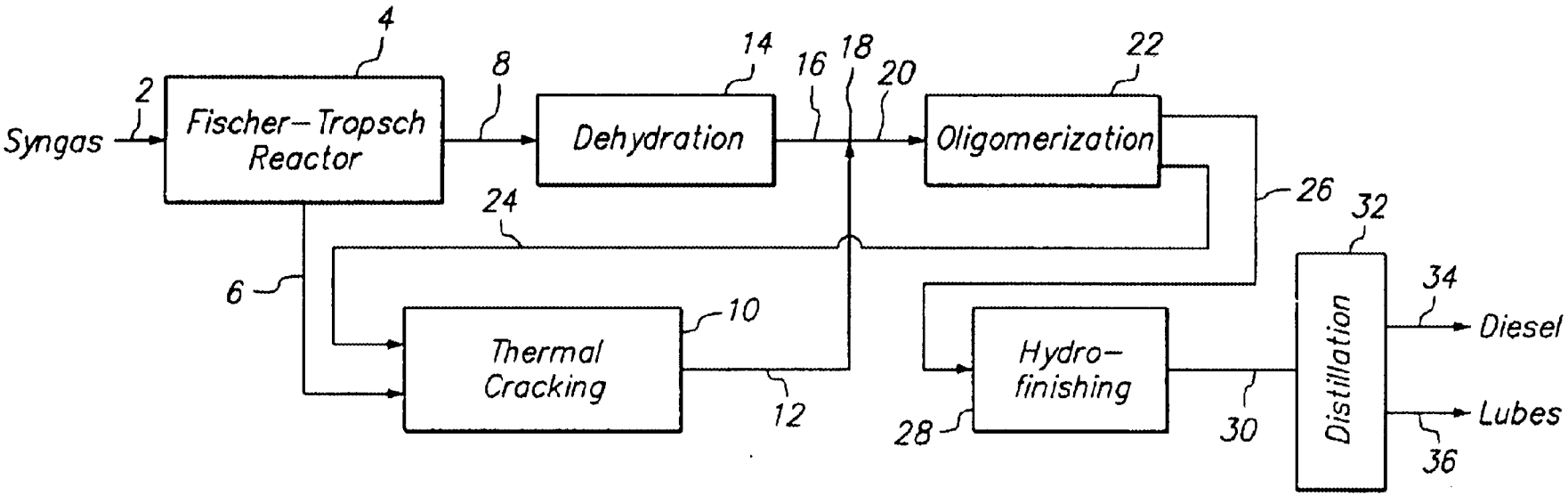
FIG. 1 is a schematic process flow diagram illustrating one embodiment of the invention.

The present invention will be more clearly understood by reference to the drawings. FIG. 1 is a process flow diagram which illustrates one embodiment of the invention. In this embodiment synthesis gas or syngas which is primarily a mixture of carbon monoxide and hydrogen is sent via line 2 to the Fischer-Tropsch reactor 4. The Fischer-Tropsch reactor is preferably a slurry-type reactor where the synthesis gas is contacted with a suitable Fischer-Tropsch catalyst to produce a mixture of various hydrocarbons in the $C_1$ to $C_{200}$ range. The products of the Fischer-Tropsch synthesis typically includes a high percentage of paraffins along with significant amounts of olefins and oxygenated hydrocarbons which mostly consist of alcohols with some lesser amounts of peroxides, ethers, aldehydes, ketones, acids and esters also present. In the slurry-type Fischer-Tropsch operation, a Fischer-Tropsch wax fraction and a Fischer-Tropsch condensate fraction are usually recovered separately from the reactor. However, in other types of Fischer-Tropsch reactors, only a single product stream may be recovered from the reactor. In the instance where the Fischer-Tropsch reactor is not a slurry-type reactor, a separator will typically be necessary to separate the condensate and wax fractions prior to further processing. In the figure, the Fischer-Tropsch wax fraction is shown as being collected from the reactor 4 by line 6 and the Fischer-Tropsch condensate fraction is shown as being collected by line 8. Preferably, the Fischer-Tropsch condensate fraction recovered from the Fisher-Tropsch reactor will have an olefinicity of at least 30% by weight, more preferably at least 40% by weight and most preferably at least 50% by weight. The Fischer-Tropsch wax fraction is carried by line 6 to the thermal cracking unit 10. In the thermal cracking unit the paraffins in the Fischer-Tropsch wax are pyrolyzed under thermal cracking conditions which have been selected to maximize the cracking of the paraffin molecules into olefins. The effluent from the thermal cracking unit, referred to in the summary as the second intermediate effluent, is collected in line 12.

Returning to the Fischer-Tropsch condensate which was collected in line 8 from the Fischer-Tropsch reactor, this fraction which contains most of the alcohols boiling below about 700° F. (370° C.) is carried by line 8 to a dehydration unit 14 where the alcohols present are dehydrated to convert them into olefins. The effluent from the dehydration unit, referred to in the summary as the first intermediate effluent, is collected by line 16 and mixed with the effluent from the thermal cracker at point 18. The mixture of the two effluents is carried by line 20 to the oligomerization unit 22 where the olefins are oligomerized to form larger molecules with increased branching. Paraffins present in the first and second intermediate effluents will pass unchanged through the oligomerization unit. Although not an essential aspect of the invention, in order to maximize the yield of lubricating base oil, the process scheme shown in FIG. 1 includes a recycle loop 24 which is intended to carry the lower boiling paraffins, preferably those boiling below about 700° F. (370° C.) back to the thermal cracking unit 10 where they are cracked into olefins after which they are returned to the oligomerization unit. The product from the oligomerization unit, referred to in the summary as the oligomerization mixture, is carried by line 26 to a hydrofinishing unit 28 where any remaining olefins present are hydrogenated. Following the hydrofinishing operation, the products are carried by line 30 to the distillation unit 32 where the products are separated. In the figure, the products are shown as diesel 34 and lubricating base oil 36. These two high value products, especially the lubricating base oil, are maximized by the present scheme. However, one skilled in the art will recognize that some lower boiling products, such as naphtha and $C_4$ minus hydrocarbons, also will likely be produced although they have not been included in the figure.

Figure 2:
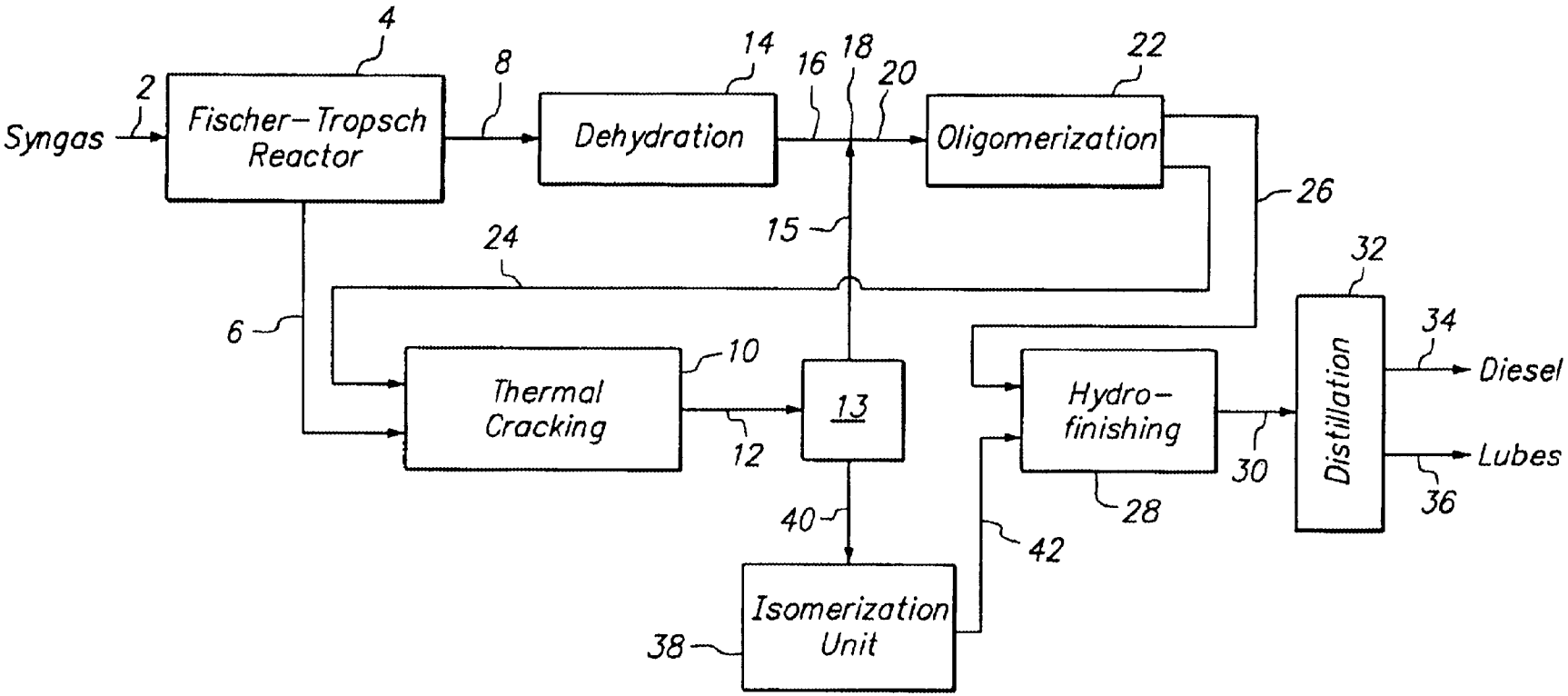
FIG. 2 is a schematic process flow diagram illustrating a second embodiment of the invention which includes a isomerization unit in association with the thermal cracking unit.

The process embodiment shown in FIG. 2 is similar to that shown in FIG. 1. The various components already described in FIG. 1 are also shown in FIG. 2. The primary difference between the two schemes resides in the inclusion of a isomerization unit in association with the thermal cracking unit. In FIG. 2, line 12 carries the cracked products to a thermal cracking distillation unit 13 where hydrocarbons boiling in the range of lubricating base oils are separated from lower boiling hydrocarbons. The lower boiling fractions are carried by line 15 to the oligomerization unit 22. Line 40 carries the heavier hydrocarbons from the thermal cracking distillation unit 13 to a isomerization unit 38 where the hydrocarbons are isomerized in order to improve the flow properties of the final products. The isomerized hydrocarbons are collected by line 42 and carried to the hydrofinishing unit 28 where the olefins are hydrogenated. Since the hydrocarbons going to the isomerization unit are not oligomerized in this scheme, the molecular weight of the isomerized hydrocarbons are not significantly increased.

Instead of recovering a hydrocarbon fraction boiling in the lubricating base oil range from the thermal cracking distillation unit 13 to be sent to the isomerization unit 38 as described above in reference to FIG. 2, it may be desirable to recover a cut boiling in the range of heavy diesel, i.e., about $C_{15}$ to $C_{19}$ hydrocarbons. In this instance, the yield of diesel in the final product slate will be increased. Due to the low cloud and pour point achieved in the isomerization operation, a particularly high quality heavy diesel is produced. As a result of these excellent flow characteristics, the cut-point between diesel and lubricating base oil may be raised which increases the yield of diesel. While extending the cut-point reduces the yield of lubricating base oil, the lubricating base oil which is collected is of particularly high quality. From the foregoing discussion, it should be understood that the process of the present invention is very flexible as to the mode of operation. For example, by adjusting the boiling range of the cut sent to the isomerization unit, the product yields and their respective flow properties may be altered to meet market requirements and specifications.

Although not shown in either figure, it is usually preferable to pre-treat the effluents prior to their introduction into the oligomerization zone in order to remove contaminants which may deactivate the oligomerization catalyst. The contaminants include water, residual oxygen compounds, and nitrogen compounds. In the schemes illustrated, a pretreatment operation located in line 20 just prior to the oligomerization unit would remove those contaminates present in both the first and second intermediate effluents. In addition, in the scheme illustrated in FIG. 2, a pretreatment operation may also be located between the thermal cracking unit and the isomerization unit. The isomerization catalysts used in the isomerization unit are also sensitive to certain contaminants which are normally present in the Fischer-Tropsch syncrude. In general, these contaminants are the same as mentioned above in regard to the oligomerization catalyst.

FISCHER-TROPSCH SYNTHESIS

In the Fischer-Tropsch synthesis process, liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300° F. to about 700° F. (149° C. to 371° C.) preferably from about 400° F. to about 550° F. (204° C. to 228° C.); pressures of from about 10 psia to about 600 psia (0.7 bars to 41 bars), preferably 30 psia to 300 psia (2 bars to 21 bars), and catalyst space velocities of from about 100 cc/g/hr. to about 10,000 cc/g/hr., preferably 300 cc/g/hr. to 3,000 cc/g/hr.

The products may range from $C_1$ to $C_{200}$ plus hydrocarbons with a majority, by weight, in the $C_5$–$C_{100}$ plus range. The reaction can be conducted in a variety of reactor types, for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of hydrogen and carbon monoxide is bubbled up in the reactor as a third phase through a slurry which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP 0609079, also completely incorporated herein by reference for all purposes.

Suitable Fischer-Tropsch catalysts comprise one or more Group VIII catalytic metals such as Fe, Ni, Co, Ru and Re, with cobalt generally being one preferred embodiment. Additionally, a suitable catalyst may contain a promoter. Thus, in one embodiment, the Fischer-Tropsch catalyst will comprise effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, $K_2O$ and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Although the alcohols present in the condensate will be converted to olefins in the dehydration step, in order to make the present process economically attractive, it is desirable that the condensate fraction recovered from the Fischer-Tropsch reactor already contain significant amounts of olefins. Since iron-based catalysts will generally yield a higher percentage of olefins and branched hydrocarbons in the Fischer-Tropsch product than a cobalt-based catalyst, an iron-based Fischer-Tropsch catalyst may represent another preferred embodiment of the present invention. Preferably, the Fischer-Tropsch condensate fraction will have an olefinicity of at least 20% by weight, more preferably at least 40% by weight, and most preferably at least 50% by weight. Weight percent olefinicity refers to the weight percent of the condensate fraction which contains at least one unsaturated carbon to carbon bond in the molecule. In addition, increased branching in the Fischer-Tropsch product will result in lower pour and cloud points in the final products.

THERMAL CRACKING

The thermal cracking step employed in the process of the present invention is intended to crack the paraffin molecules into lower molecular weight olefins. Although batch pyrolysis reactors such as employed in delayed coking or in cyclic batch operations could be used to carry out this step, generally a continuous flow-through operation is preferred in which the feed is first preheated to a temperature sufficient to vaporize most or all of the feed after which the vapor is passed through a tube or tubes. A desirable option is to bleed any remaining nonvaporized hydrocarbons prior to entering the tubes in the cracking furnace. Preferably, the thermal cracking is conducted in the presence of steam which serves as a heat source and also helps suppress coking in the reactor. Details of a typical steam thermal cracking process may be found in U.S. Pat. No. 4,042,488, hereby incorporated by reference in its entirety. Although catalyst is generally not used in carrying out the thermal cracking operation, it is possible to conduct the operation in a fluidized bed in which the vaporized feed is contacted with hot fluidized inert particles, such as fluidized particles of coke.

In performing the thermal cracking operation, Applicants have found that it is preferable that the feed be maintained in the vapor phase during the cracking operation to maximize the production of olefins. It has been discovered that liquid phase cracking results in the formation of significant amounts of paraffins which are unreactive in the oligomerization operation and therefore, are undesired. In the pyrolysis zone, the cracking conditions should be sufficient to provide a cracking conversion of greater than 30% by weight of the paraffins present. Preferably, the cracking conversion will be at least 50% by weight and most preferably at least 70% by weight. The optimal temperature and other conditions in the pyrolysis zone for the cracking operation will vary somewhat depending on the feed. In general, the temperature must be high enough to maintain the feed in the vapor phase but not so high that the feed is overcracked, i.e., the temperature and conditions should not be so severe that excessive $C_4$ minus hydrocarbons are generated. The temperature in the pyrolysis zone normally will be maintained at a temperature of between about 950° F. (510° C.) and about 1600° F. (870° C.). The optimal temperature range for the pyrolysis zone in order to maximize the production of olefins from the Fischer-Tropsch wax will depend upon the endpoint of the feed. In general, the higher the carbon number, the higher the temperature required to achieve maximum conversion. Accordingly, some routine experimentation may be necessary to identify the optimal cracking conditions for a specific feed. The pyrolysis zone usually will employ pressures maintained between about 0 atmospheres and about 5 atmospheres, with pressures in the range of from about 0 to about 2 generally being preferred. Although the optimal residence time of the wax fraction in the reactor will vary depending on the temperature and pressure in the pyrolysis zone, typical residence times are generally in the range of from about 1.5 seconds to about 500 seconds, with the preferred range being between about 5 seconds and about 300 seconds.

DEHYDRATION

The alcohols in the Fischer-Tropsch condensate are dehydrated to convert them into olefins prior to the oligomerization step. In general, the dehydration of alcohols may be accomplished by processing the feedstock over a catalyst, such as gamma alumina. Dehydration of alcohols to olefins is discussed in Chapter 5, "Dehydration" in *Catalytic Processes and Proven Catalysts* by Charles L. Thomas, Academic Press, 1970.

PRE-TREATMENT TO REMOVE CONTAMINANTS

Oxygenates, including alcohols not converted in the dehydration step, nitrogen compounds, and water can deactivate the catalyst in the oligomerization reactor and in the isomerization unit. Therefore, it is preferred to remove such contaminants from the feedstock prior to oligomerization and isomerization using a pretreatment step. Means for removing these contaminants are in the literature and are well known to those skilled in the art. For example, the contaminants may be removed by extraction, water washing, adsorption, or by a combination of these processes. In some process schemes the dehydration step and contaminant removal may be combined into a single operation. Preferably, the pre-treatment should reduce the nitrogen in the feedstock to below 50 ppm, more preferably below 10 ppm, and most preferably to less than 1 ppm.

OLIGOMERIZATION

The present invention is intended to maximize the yield of heavy products, especially lubricating base oils and diesel, by oligomerizing the olefins in the Fischer-Tropsch condensate and those olefins produced both in the dehydration operation and the thermal cracking operation. During oligomerization the lighter olefins are converted into heavier products. The carbon backbone of the oligomers will also display branching at the points of molecular addition. Due to the introduction of branching into the molecule, the pour point of the products are reduced making the final products of the oligomerization operation excellent products themselves or excellent candidates for blending components to upgrade lower quality conventional petroleum-derived products to meet market specifications. In the event the pour point is too high, the oligomerization product may be sent to a catalytic dewaxing unit or, alternatively, the boiling range of the second intermediate effluent from the thermal cracker may be adjusted prior to going to the oligomerization operation to make a lower pour point and lower cloud point product. By lowering the upper boiling point of the thermal cracker effluent, the average molecular weight of the feed to the oligomerization unit will be lowered. Lower molecular weight molecules will yield increased branching in the oligomerization mixture which will translate into a lower pour point and cloud point in the final product. The higher boiling fractions may be recycled to the thermal cracker for further processing. As already noted above, the selection of the Fischer-Tropsch catalyst, such as by use of an iron-based catalyst, may also be used to increase branching in the molecules of the final products.

The oligomerization of olefins has been well reported in the literature, and a number of commercial processes are available. See, for example, U.S. Pat. Nos. 4,417,088; 4,434,308, 4,827,064; 4,827,073; and 4,990,709. Various types of reactor configurations may be employed, with the fixed catalyst bed reactor being used commercially. More recently, performing the oligomerization in an ionic liquids media has been proposed, since the contact between the catalyst and the reactants is efficient and the separation of the catalyst from the oligomerization products is facilitated. Preferably, the oligomerized product will have an average molecular weight at least 10 percent higher than the initial feedstock, more preferably at least 20 percent higher. The oligomerization reaction will proceed over a wide range of conditions. Typical temperatures for carrying out the reaction are between about 32° F. (0° C.) and about 800° F. (425° C.). Other conditions include a space velocity from 0.1 to 3 LHSV and a pressure from 0 to 2000 psig. Catalysts for the oligomerization reaction can be virtually any acidic material, such as, for example, zeolites, clays, resins, $BF_3$ complexes, HF, $H_2SO_4$, $AlCl_3$, ionic liquids (preferably ionic liquids containing a Bronsted or Lewis acidic component or a combination of Bronsted and Lewis acid components), transition metal-based catalysts (such as $Cr/SiO_2$), superacids, and the like. In addition, non-acidic oligomerization catalysts including certain organometallic or transition metal oligomerization catalysts may be used, such as, for example, zirconocenes.

ISOMERIZATION

Isomerization is intended to achieve high conversion levels of wax to non-waxy iso-paraffins while at the same time minimizing the conversion by cracking. Since wax conversion can be complete, or at least very high, this process typically does not need to be combined with additional dewaxing processes to produce a lubricating oil base stock with an acceptable pour point. Isomerization operations suitable for use with the present invention typically uses catalyst comprising an acidic component and may optionally contain an active metal component having hydrogenation activity. The acidic component of the catalysts preferably include an intermediate pore SAPO, such as SAPO-11, SAPO-31, and SAPO-41, with SAPO-11 being particularly preferred. Intermediate pore zeolites, such as ZSM-22, ZSM-23, SSZ-32, ZSM-35, and ZSM-48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 5.3 to about 6.5 Angstrom when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having an hydrogenation component, it is usually preferred that the metal be deposited on the catalyst using a non-aqueous method. Non-zeolitic molecular sieves include tetrahedrally-coordinated [AlO2] and PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

HYDROFINISHING

Hydrofinishing operations are intended to improve the UV stability and color of the products. It is believed this is accomplished by saturating the double bonds present in the hydrocarbon molecule. A general description of the hydrofinishing process may be found in U.S. Pat. Nos. 3,852,207 and 4,673,487. As used in this disclosure, the term UV stability refers to the stability of the lubricating base oil or other products when exposed to ultraviolet light and oxygen. Instability is indicated when a visible precipitate forms or darker color develops upon exposure to ultraviolet light and air which results in a cloudiness or floc in the product. Lubricating base oils and diesel products prepared by the process of the present invention will require UV stabilization before they are suitable for use in the manufacture of commercial lubricating oils and marketable diesel.

In the present invention, the total pressure in the hydrofinishing zone will be above 500 psig, preferably above 1000 psig, and most preferably will be above 1500 psig. The maximum total pressure is not critical to the process, but due to equipment limitations the total pressure will not exceed 3000 psig and usually will not exceed about 2500 psig.

Temperature ranges in the hydrofinishing zone are usually in the range of from about 300° F. (150° C.) to about 700° F. (370° C.), with temperatures of from about 400° F. (205° C.) to about 500° F. (260° C.) being preferred. The LHSV is usually within the range of from about 0.2 to about 2.0, preferably 0.2 to 1.5, and most preferably from about 0.7 to 1.0. Hydrogen is usually supplied to the hydrofinishing zone at a rate of from about 1000 to about 10,000 SCF per barrel of feed. Typically, the hydrogen is fed at a rate of about 3000 SCF per barrel of feed.

Suitable hydrofinishing catalysts typically contain a Group VIII noble metal component together with an oxide support. Metals or compounds of the following metals are contemplated as useful in hydrofinishing catalysts include ruthenium, rhodium, iridium, palladium, platinum, and osmium. Preferably, the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. Nos. 3,852,207; 4,157,294 and 4,673,487.

The process of the present invention is particularly advantageous because it produces a large volume of lubricating base oils which has a higher value than the lighter products discussed above. The lubricating base oil is especially high in quality due to its high paraffinic composition and excellent oxidation stability. Lubricating base oil produced by the present process may be used to make high value premium lubricating products. The diesel produced by the process also is particularly high in quality due to its low sulfur content, low level of aromatics, high cetane number, and very low pour point and cloud point.

The following example will further illustrate the invention, but is not intended to be a limitation upon the scope of the invention.

EXAMPLE

A commercially-available Fischer-Tropsch wax prepared using an iron-based catalyst was thermally cracked at 1250° F. The whole thermally-cracked product was distilled to yield a 650° F. minus (343° C. minus) fraction (42% of whole product) and a 650° F. plus bottoms. The olefin content of the 650° F. minus fraction was 91–100% olefins, as measured by bromine number and FIAM (ASTM D1319).

The 650° F. minus olefinic fraction was oligomerized over a Cr/SiO2 catalyst at 0.5 LHSV, 1600 psig total pressure, and 750° F. The yield of 650° F. plus product was 59 wt %. The 650° F. plus product analyses were:

| | |
|---|---|
| Vis @ 40° C., cSt | 35.83 |
| Vis @ 100° C., cSt | 6.892 |
| VI | 155 |
| Pour Point, ° C. | 9 |
| Cloud Point, ° C. | 28 |
| 1000° F. Plus (538° C. Plus), wt % | 24.2 |

In this example, the pour point and the cloud point are higher than would normally be desirable for the production of a high quality lubricating base oil. In actual practice, the flow properties of the product may be improved by lowering the boiling point of the feed to the oligomerization step by recovering a lower boiling point cut from the thermal cracking step. Alternatively, the oligomerization product may be subjected to catalytic isomerization.

What we claim is:

1. A process for upgrading a Fischer-Tropsch feedstock which comprises (a) recovering from a Fischer-Tropsch reactor a Fischer-Tropsch wax fraction containing paraffins and a Fischer-Tropsch condensate fraction, wherein the Fischer-Tropsch condensate fraction contains alcohols boiling below about 370° C.;

(b) contacting the Fischer-Tropsch condensate fraction with a dehydration catalyst in a dehydration zone under dehydration conditions selected to convert at least some of the alcohols present in said fraction into olefins and recovering a first intermediate effluent from said dehydration zone;

(c) pyrolyzing the Fischer-Tropsch wax fraction in a thermal cracking zone under thermal cracking conditions pre-selected to crack paraffins molecules in the Fischer-Tropsch wax to form olefins and collecting a second intermediate effluent from the thermal cracking zone;

(d) passing the first and second intermediate effluents recovered from steps (b) and (c) to an oligomerization zone containing an oligomerization catalyst under oligomerization conditions to form an oligomerization mixture having a higher molecular weight than either of said first and second intermediate effluent;

(e) hydrofinishing the oligomerization mixture in a hydrofinishing zone; and (f) recovering from the hydrofinishing zone a $C_{10}$ plus hydrocarbon product.

2. The process of claim 1 wherein the $C_{10}$ plus hydrocarbon product comprises a lubricating base oil.

3. The process of claim 1 wherein the $C_{10}$ plus hydrocarbon product comprises diesel.

4. The process of claim 1 wherein naphtha is also recovered from the hydrofinishing zone.

5. The process of claim 1 wherein at least a part of the oligomerization mixture boiling below about 370° C. is separated prior to hydrofinishing and is recycled to the thermal cracking zone.

6. The process of claim 1 wherein at least part of the second intermediate effluent boiling above about 290° C. is passed to an isomerization zone where it is contacted with an isomerization catalyst under isomerizing conditions, whereby an isomerized effluent having a lowered pour point is recovered.

7. The process of claim 6 wherein the part of the second intermediate effluent that is sent to the isomerization unit includes a $C_{20}$ hydrocarbon fraction.

8. The process of claim 6 wherein the isomerization catalyst contains an intermediate pore SAPO.

9. The process of claim 8 wherein the SAPO is selected from the group consisting of SAPO-11, SAPO-31, and SAPO-41.

10. The process of claim 9 wherein the SAPO is SAPO-11.

11. The process of claim 6 wherein the isomerization catalyst contains an intermediate pore zeolite.

12. The process of claim 11 wherein the intermediate pore zeolite is selected from the group consisting of ZSM-22, ZSM-23, SSZ-32, ZSM-35, and ZSM-48.

13. The process of claim 6 wherein the isomerized effluent is passed to the hydrofinishing zone.

14. The process of claim 1 wherein the oligomerization mixture recovered from the oligomerization zone has an average molecular weight at least 10 percent higher than either of said first and second intermediate effluents.

15. The process of claim 14 wherein the oligomerization mixture recovered from the oligomerization zone has an average molecular weight at least 20 percent higher than either of said first and second effluents.

16. The process of claim 15 wherein the oligomerization takes place in an ionic liquid media.

17. The process of claim 1 including the additional step of removing contaminants that will deactivate the oligomerization catalyst from the first intermediate effluent prior to passing it into the oligomerization zone.

18. The process of claim 1 wherein the Fischer-Tropsch wax fraction is in the vapor phase when it is pyrolyzed in the thermal cracking zone.

19. The process of claim 18 wherein the temperature in the thermal cracking zone is within the range of from about 510° C. to about 870° C.

20. The process of claim 18 wherein the pressure in the thermal cracking zone is within the range of from about 0 atmospheres to about 5 atmospheres.

21. The process of claim 20 wherein the pressure in the thermal cracking zone is within the range of from about 0 atmospheres to about 2 atmospheres.

22. The process of claim 1 wherein the thermal cracking zone is contained in a continuous flow through reactor.

23. The process of claim 22 wherein steam is present in the thermal cracking zone.

24. The process of claim 22 wherein the residence time of the wax fraction in the reactor is in the range of from about 1.5 seconds to about 500 seconds.

25. The process of claim 24 wherein the residence time of the wax fraction in the reactor is in the range of from about 5 seconds to about 300 seconds.

26. The process of claim 1 wherein the cracking conversion in the thermal cracking zone of the paraffins in the wax fraction is greater than 30% by weight.

27. A process for increasing the yield of lubricating base oil from a Fischer-Tropsch plant which comprises:

(a) contacting a syngas with a Fischer-Tropsch catalyst under Fischer-Tropsch reaction conditions pre-selected to yield a Fischer-Tropsch product having an olefinicity of at least 20% by weight;

(b) recovering from the Fischer-Tropsch product a Fischer-Tropsch wax fraction containing paraffins and a Fischer-Tropsch condensate fraction, wherein the Fischer-Tropsch condensate fraction contains alcohols boiling below about 370° C.;

(c) contacting the Fischer-Tropsch condensate fraction with a dehydration catalyst in a dehydration zone under dehydration conditions selected to convert at least some of the alcohols present in said fraction into olefins and recovering a first intermediate effluent from said dehydration zone;

(d) raising the temperature the Fischer-Tropsch wax fraction sufficiently to vaporize the fraction;

(e) steam cracking the vaporized Fischer-Tropsch wax fraction in a flow through reactor under thermal cracking conditions pre-selected to achieve a cracking conversion of the paraffin molecules in the Fischer-Tropsch wax of greater than 30% by weight and collecting a second intermediate effluent from the flow through reactor;

(f) passing the first and second intermediate effluents recovered from steps (c) and (e) to an oligomerization zone containing an oligomerization catalyst under oligomerization conditions to form an oligomerization mixture having a higher molecular weight than either of said first and second intermediate effluent;

(g) hydrofinishing the oligomerization mixture in a hydrofinishing zone; and (h) recovering from the hydrofinishing zone a lubricating base oil product.

28. The process of claim 27 wherein the temperature in the flow through reactor is within the range of from about 510° C. to about 705° C.

29. The process of claim 27 wherein the pressure in the flow through reactor is within the range of from about 0 atmospheres to about 5 atmospheres.

30. The process of claim 29 wherein the pressure in the flow through reactor is within the range of from about 0 atmospheres to about 2 atmospheres.

31. The process of claim 27 wherein the residence of the wax fraction in the reactor is in the range of from about 1.5 seconds to about 500 seconds.

32. The process of claim 27 wherein the residence of the wax fraction in the reactor is in the range of from about 5 seconds to about 300 seconds.

33. The process of claim 27 wherein the cracking conversion in the thermal cracking zone of the paraffins in the wax fraction is greater than 50% by weight.

34. The process of claim 33 wherein the cracking conversion in the thermal cracking zone of the paraffins in the wax fraction is greater than 70% by weight.

35. The process of claim 27 wherein the olefinicity of the Fischer-Tropsch condensate fraction is at least 40% by weight.

36. The process of claim 35 wherein the olefinicity of the Fischer-Tropsch condensate fraction is at least 50% by weight.

37. The process of claim 27 wherein the oligomerization takes place in a an ionic liquid media.

38. The process of claim 27 further including the step of removing any nonvaporized Fischer-Tropsch wax prior to steam cracking the vaporized Fischer-Tropsch wax in step (e).

39. The process of claim 27 wherein the Fischer-Tropsch catalyst contains cobalt as an active metal.

40. The process of claim 27 wherein the Fischer-Tropsch catalyst contains iron as an active metal.

* * * * *